US009161629B2

(12) United States Patent
Huang

(10) Patent No.: US 9,161,629 B2
(45) Date of Patent: Oct. 20, 2015

(54) CHAIR ASSEMBLY

(71) Applicant: Tsung-Chieh Huang, Kaohsiung (TW)

(72) Inventor: Tsung-Chieh Huang, Kaohsiung (TW)

( * ) Notice: Subject to any disclaimer, the term of this patent is extended or adjusted under 35 U.S.C. 154(b) by 0 days.

(21) Appl. No.: 13/937,221

(22) Filed: Jul. 9, 2013

(65) Prior Publication Data

US 2015/0015051 A1 Jan. 15, 2015

(51) Int. Cl.

| | |
|---|---|
| ***A47C 3/04*** | (2006.01) |
| ***A47C 5/06*** | (2006.01) |
| ***A47C 5/10*** | (2006.01) |
| ***A47C 4/02*** | (2006.01) |
| ***A47C 7/28*** | (2006.01) |

(52) U.S. Cl.

CPC ... *A47C 4/02* (2013.01); *A47C 3/04* (2013.01); *A47C 5/06* (2013.01); *A47C 5/10* (2013.01); *A47C 7/282* (2013.01)

(58) Field of Classification Search

CPC ..... A47C 5/04; A47C 5/06; A47C 7/16; A47C 3/04; A47C 4/03; A47C 5/10; A47C 7/282

USPC ..... 297/218.5, 218.4, 448.1, 448.2, 451.3, 297/239, 440.22, 440.21, 452.18, 452.19

See application file for complete search history.

(56) References Cited

U.S. PATENT DOCUMENTS

| | | | | | |
|---|---|---|---|---|---|
| 3,003,817 | A * | 10/1961 | King | 297/440.22 |
| 3,278,227 | A * | 10/1966 | Rowland | 297/239 |
| 3,365,233 | A * | 1/1968 | Uyeda et al. | 297/239 |
| 3,431,022 | A * | 3/1969 | Poppe et al. | 297/448.1 |
| 3,774,967 | A * | 11/1973 | Rowland | 297/447.3 |
| 3,847,433 | A * | 11/1974 | Acton et al. | 297/239 |
| 4,548,441 | A * | 10/1985 | Ogg | 297/448.2 |
| 5,649,742 | A * | 7/1997 | Liu | 297/452.2 |
| 5,961,184 | A * | 10/1999 | Balderi et al. | 297/448.1 |
| 6,957,860 | B1 * | 10/2005 | Leist et al. | 297/239 |
| 2002/0153757 | A1 * | 10/2002 | Lo | 297/448.1 |
| 2003/0090140 | A1 * | 5/2003 | Belic | 297/452.19 |
| 2004/0251729 | A1 * | 12/2004 | Olson | 297/452.14 |
| 2008/0191528 | A1 * | 8/2008 | Hsiao | 297/218.4 |
| 2010/0019549 | A1 * | 1/2010 | Huang | 297/170 |
| 2010/0176646 | A1 * | 7/2010 | Rowland et al. | 297/452.56 |
| 2012/0187741 | A1 * | 7/2012 | Kumazawa | 297/463.1 |
| 2012/0248844 | A1 * | 10/2012 | Lee | 297/440.11 |
| 2012/0299348 | A1 * | 11/2012 | Kusch et al. | 297/232 |

* cited by examiner

*Primary Examiner* — Ryan Kwiecinski

(57) ABSTRACT

A chair assembly includes a frame, seat, and a back. The frame has two foot frames and two back supports. The foot frame has an upper rod, and an extending supporting rib is formed to the upper rod. The back support has an assembling sheet. The seat has a cut for receiving the upper rod of the foot frame on two lateral sides thereof, and the rear side of the seat also has a cut for receiving the transverse shaft of the frame. The back has two pin holes on two lateral sides of the bottom thereof for receiving the back supports of the frame, and the pin hole has a slot for receiving the assembling sheet of the back support. The seat is fixed to the frame, and the back is fixed to the frame through the assembling sheet of the back support with two fastening components.

3 Claims, 10 Drawing Sheets

CHAIR ASSEMBLY

FIELD OF THE INVENTION

The present invention relates to chairs, and particular to a chair assembly accomplished the assembling between a seat and a frame with one fastening component and the assembling between a back and the frame with two fastening components. The chair assembly has a nice and tidy appearance without seeing the fastening between the parts.

DESCRIPTION OF THE PRIOR ART

Chairs usually consist of a frame, seat, and back. There are many types of chair such as wooden chair with wooden seat and back, wooden chair with cushion seat and back, metal chair with metal seat and back, or metal chair with cushion seat and back.

Conventional assembly of chair usually uses a lot of screws to assemble the seat and back to the frame. Such assembly is complicated and time-consuming with higher manufacture cost. An outer appearance will be harmed by the screws fastening the parts of the chair.

Therefore, for the purpose of reduce the cost of manufacture and transportation, to create a chair assembly with simple assembling and better appearance is an urgent object.

SUMMARY OF THE PRESENT INVENTION

Accordingly, the primary object of the present invention is to provide a chair assembly of lower cost for manufacture and transportation. The secondary object of the present invention is to provide a chair assembly of better outer appearance without seeing the fastening between the parts thereof.

To achieve above objects, the frame has two foot frames and two back supports. The foot frame has an upper rod, and an extending supporting rib is formed to the upper rod. The back support has an assembling sheet. A transverse shaft linking the two foot frames is formed to the rear side of the frame, and the transverse shaft has an assembling sheet. The seat has a cut for receiving the upper rod of the foot frame on two lateral sides thereof, and the rear side of the seat also has a cut for receiving the transverse shaft of the frame. The back has two pin holes on two lateral sides of the bottom thereof for receiving the back supports of the frame, and the pin hole has a slot for receiving the assembling sheet of the back support. The seat is fixed to the frame through the assembling sheet of the transverse shaft with a fastening component, and the back is fixed to the frame through the assembling sheet of the back support with two fastening components. With the simple and time-saving assembling, the chair having a tidy appearance without seeing any fastening between the parts will achieve a lower cost of manufacture and transportation.

DETAILED DESCRIPTION OF THE INVENTION

Figure 1:
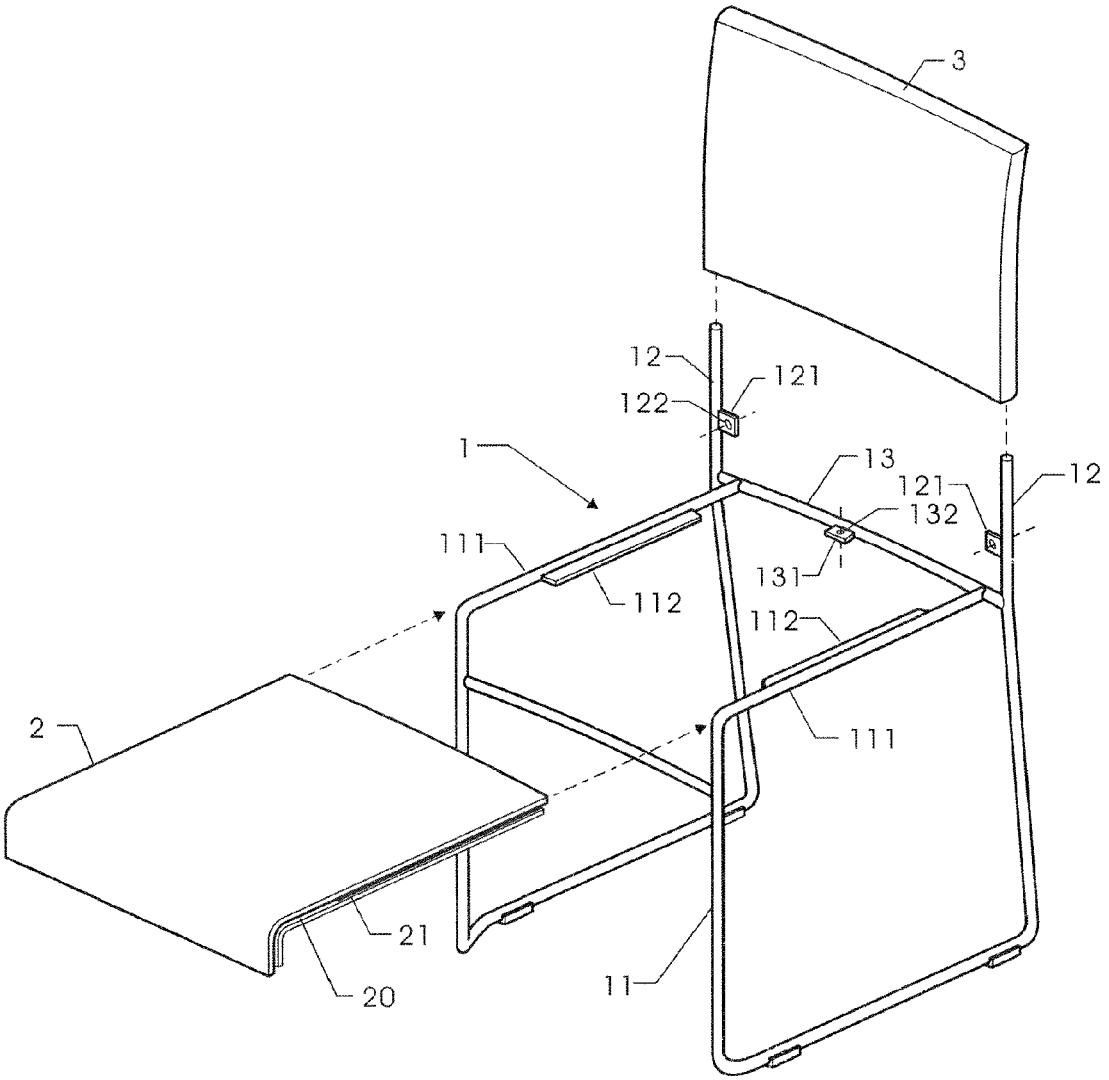
FIG. 1 is an exploded view showing the first embodiment of the present invention.
Figure 2:
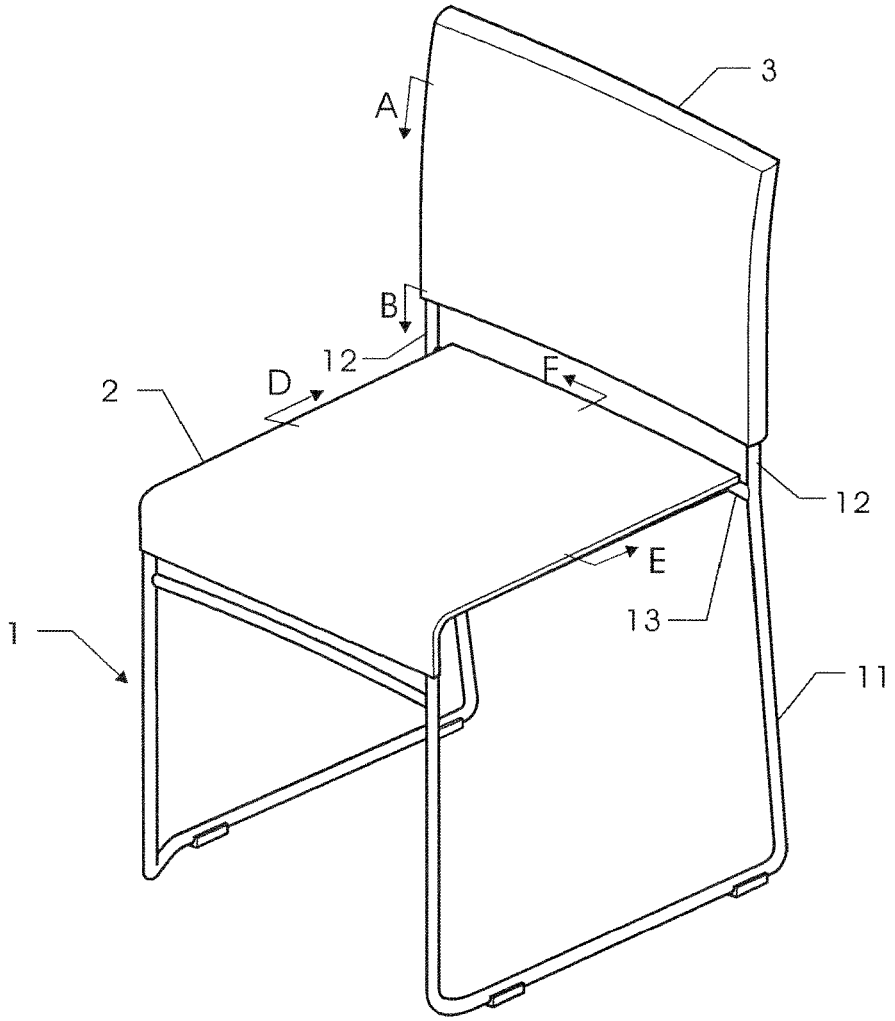
FIG. 2 is a schematic view showing the first embodiment of the present invention.
Figure 3:
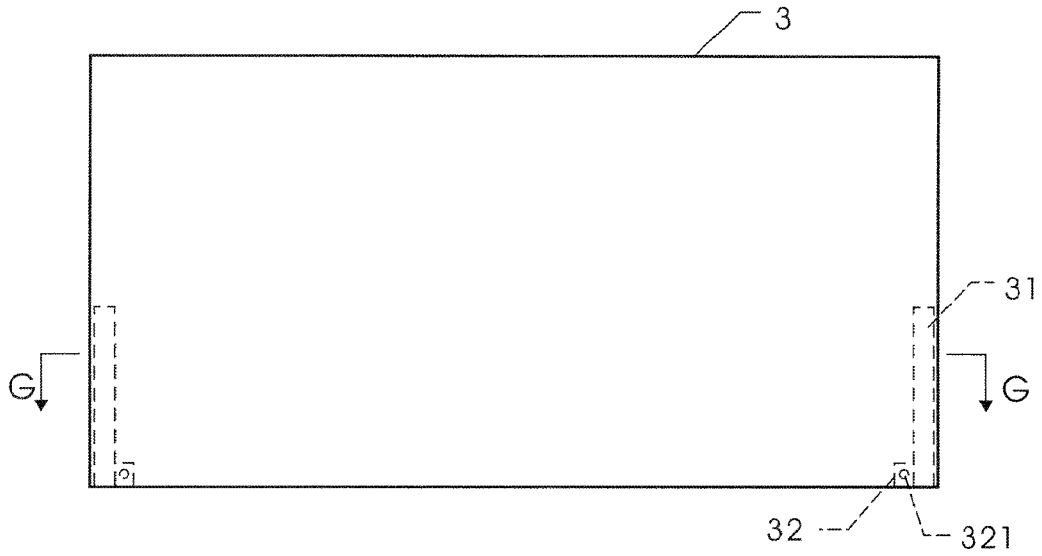
FIG. 3 is a front view showing a back of the present invention.
Figure 4:
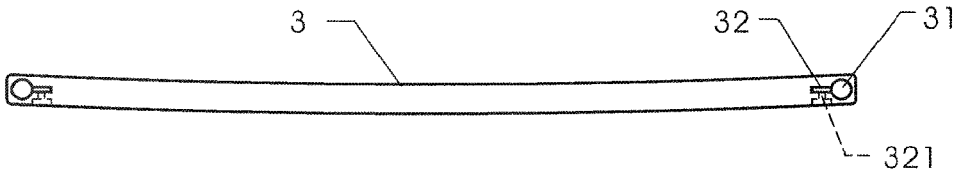
FIG. 4 is a bottom view of the back of the present invention.
Figure 5:
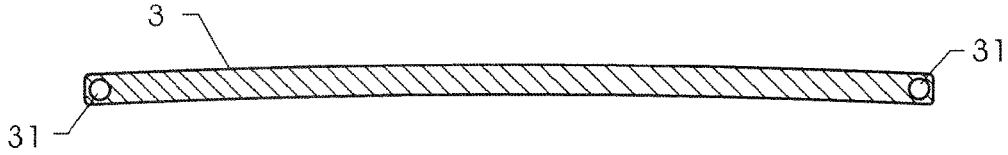
FIG. 5 is a cross-section view through a G-G line in FIG. 3.
Figure 6:
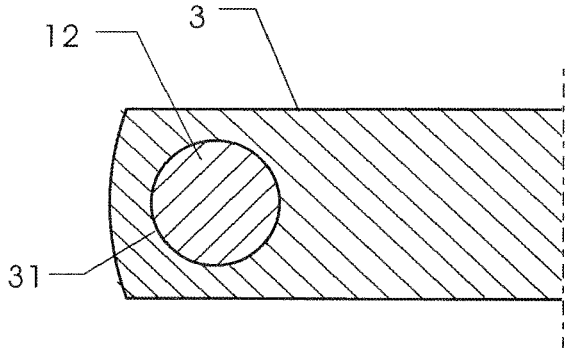
FIG. 6 is a cross-section view through an A line in FIG. 2.
Figure 7:
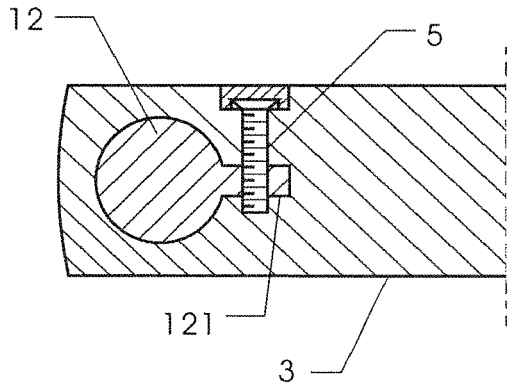
FIG. 7 is a cross-section view through a B line in FIG. 2.
Figure 9:
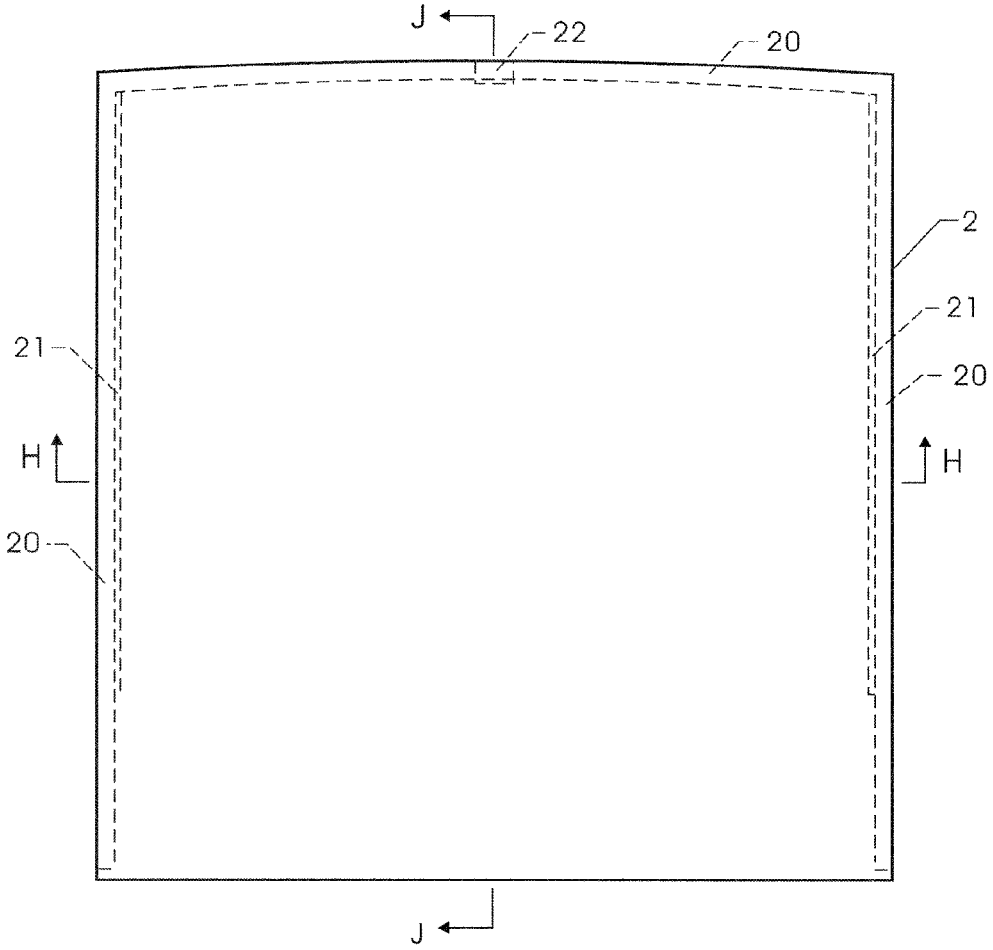
FIG. 9 is a bottom view showing the seat of the present invention.
Figure 8:
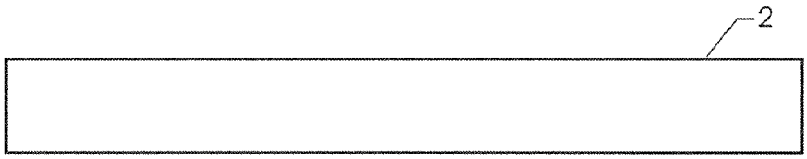
FIG. 8 is a front view showing a seat of the present invention.
Figure 10:
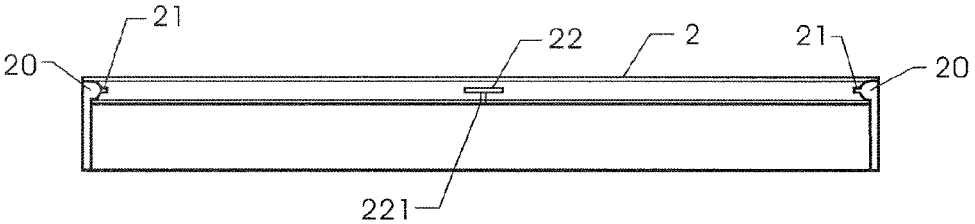
FIG. 10 is a rear view showing the seat of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1, 2, 17, and 18, embodiments of a chair assembling according to the present invention are illustrated.

Referring to FIGS. 1 to 16, the first embodiment includes a frame 1, seat 2, and back 3. The frame 1 includes two linked foot frames 11 for holding the seat 2 and a back support 12 for assembling the back 3. An upper rod 111 of the foot frame 11 has an extending supporting rib 112 for holding the seat 2. The back support 12 extending from the frame 1 has an assembling sheet 121 for assembling the back 3, the assembling sheet 121 has a through hole 122. A transverse shaft 13 linking the two foot frames on the rear of the frame 1 has a assembling sheet 131, the assembling sheet 131 has a through hole 132.

Figure 11:
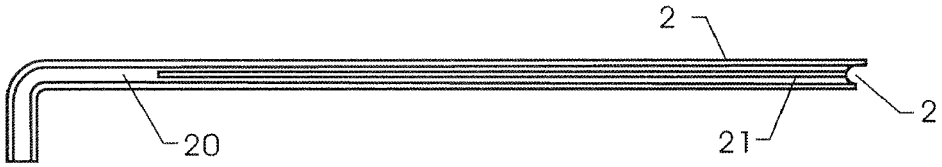
FIG. 11 is a right side view showing the seat of the present invention.
Figure 12:
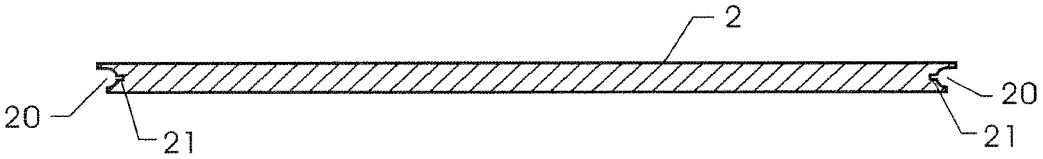
FIG. 12 is a cross-section view through an H-H line in FIG. 9.
Figure 13:
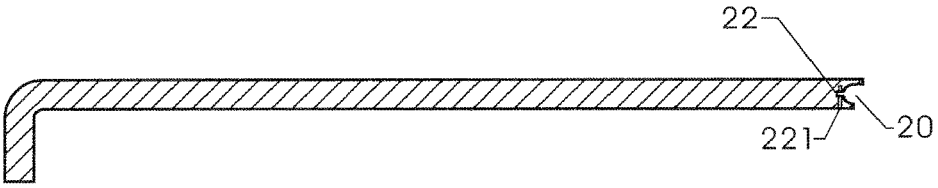
FIG. 13 is a cross-section view through a J-J line in FIG. 9.
Figure 14:
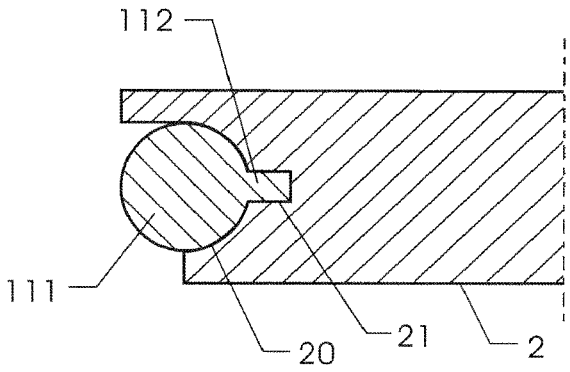
FIG. 14 is a cross-section view through a D line in FIG. 2.
Figure 15:
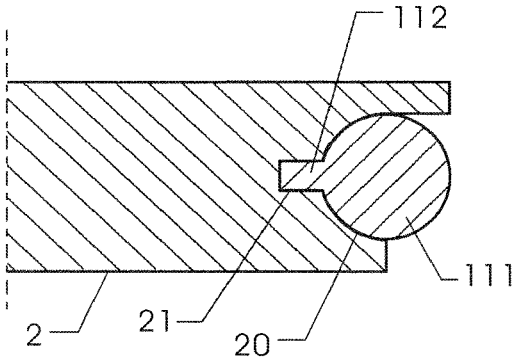
FIG. 15 is a cross-section view through an E line in FIG. 2.
Figure 16:
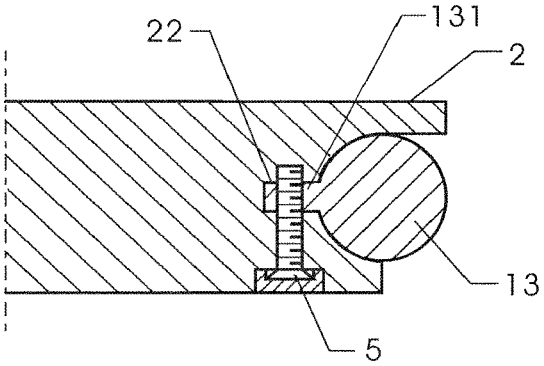
FIG. 16 is a cross-section view through an F line in FIG. 2.

Referring to FIGS. 8 to 16, the seat 2 has a cut 20 for receiving the upper rod 111 of the foot frame 11 on two sides of the seat 2 as shown in FIGS. 12, 14, and 15. A slot 21 is formed to the cut 20 for receiving the supporting rib 112. The rear side of the seat 2 also has a cut 20 for receiving the transverse shaft 13 as shown in FIGS. 11, 13, and 16, and a positioning slot 22 is formed to the cut 20 for receiving the assembling sheet 131. A through hole 221 penetrating the positioning slot 22 is formed to a rear bottom of the seat 2 so as to receive a fastening component 5 such as a bolt.

Referring to FIGS. 3 to 7, two pin holes 31 are formed to two lateral sides of the bottom of the back 3 for receiving the back supports 12 of the frame 1. A slot 32 is formed besides the pin hole 31 for receiving the assembling sheet 121. A through hole 321 penetrating the slot 32 is formed to the rear of the back 3 so as to receive a fastening component 5 such as a bolt.

Figure 19:
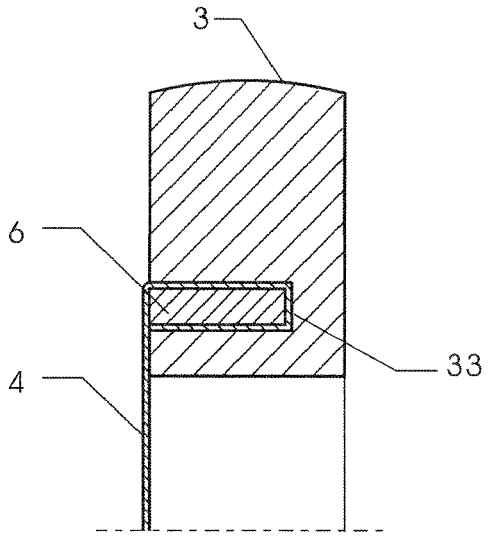
FIG. 19 is a cross-section view through a K line in FIG. 18.
Figure 20:
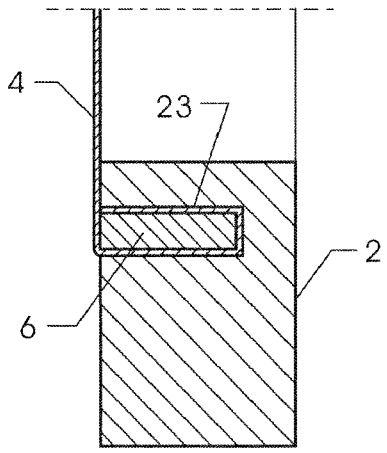
FIG. 20 is a cross-section view through a L line in FIG. 18.

Referring to FIGS. 17 to 20, the second embodiment of the present invention is illustrated. The embodiment includes a frame 1, seat 2, back 3, and net cloth 4 arranged to the seat 2 and back 3. The seat 2 is a frame having a central cut as shown in FIG. 20, and the back 3 is also a frame having a central cut as shown in FIG. 19. A groove 23 enclosing the central cut of the seat 2 is formed to an upper surface of the seat 2 for fastening edges of the net cloth 4 so that the net cloth 4 will cover the central cut of the seat 2. A groove 33 enclosing the central cut of the back 3 is formed to a front side of the back 3 for fastening edges of the net cloth 4 so that the net cloth 4 will cover the central cut of the back 3.

Referring to FIGS. 19 and 20, the edges of the net cloth 4 are wrapped around a rectangle flexible positioning frame 6 from an outer rim of the frame 6. The cross-section of the positioning frame 6 is rectangular. The edges of the net cloth 4 are wrapped and fixed to the positioning frame 6 (by sewing or other methods). The positioning frames 6 covered by the net clothes 4 are inserted into the groove 23 and 33 of the seat 2 and back 3 respectively. While the net cloth 4 is pressed by body weight, the tension will pull the positioning frame 6 towards the groove holding the positioning frame 6 so that the positioning frame 6 will not escape from the groove.

Figure 17:
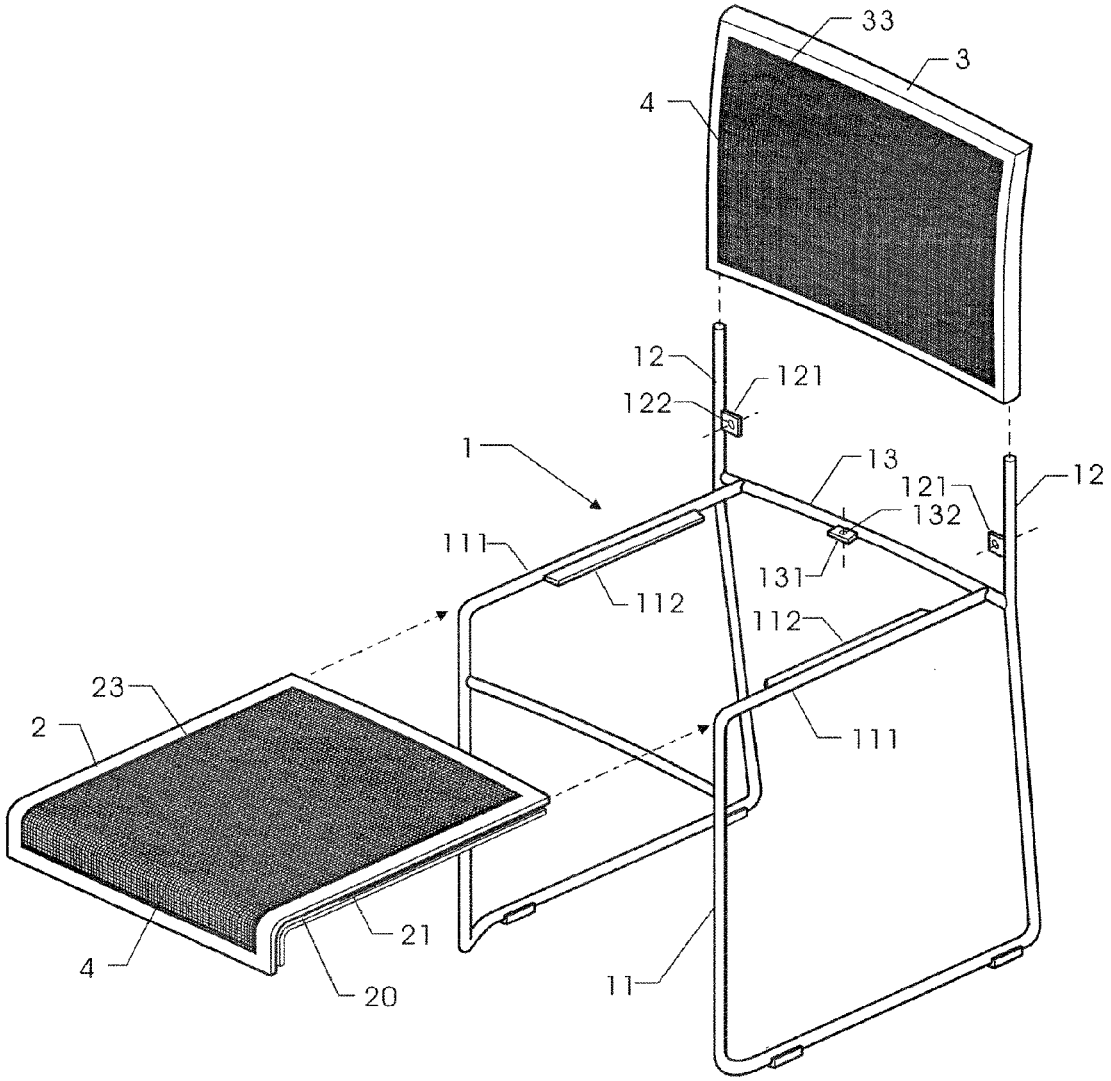
FIG. 17 is an exploded view showing the second embodiment of the present invention.
Figure 18:
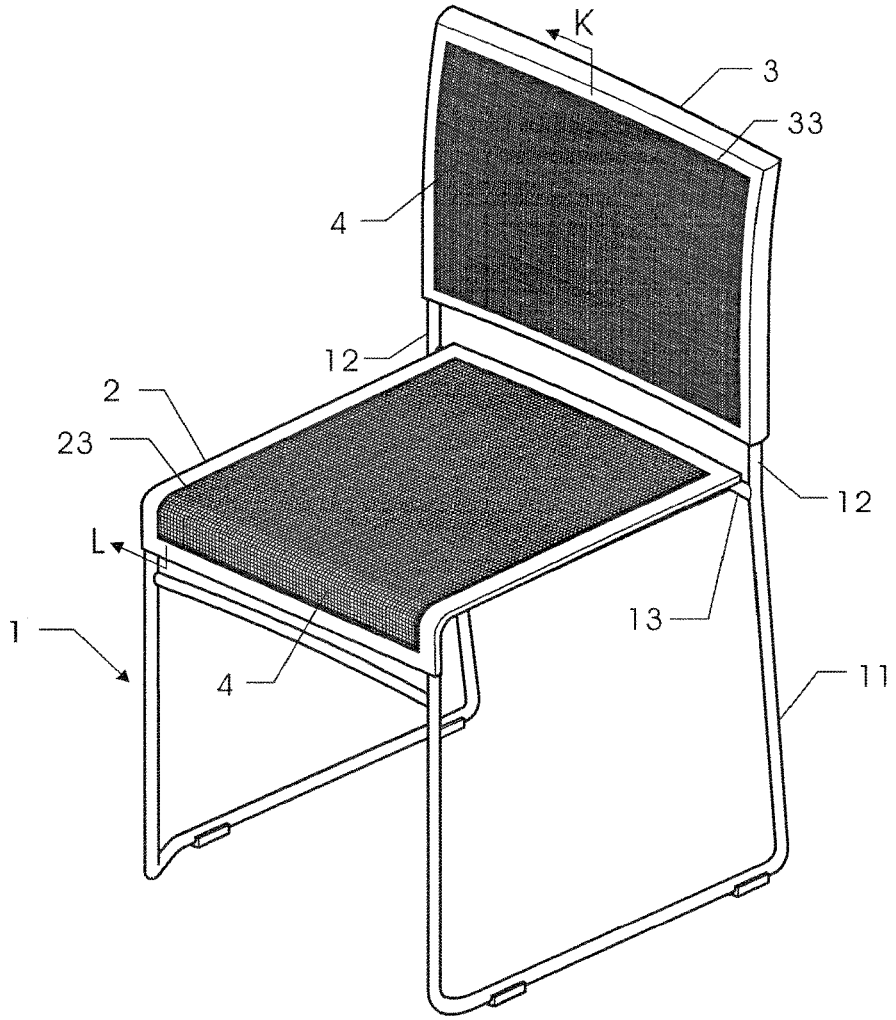
FIG. 18 is a schematic view showing the second embodiment of the present invention.

Referring to FIGS. 1 and 17, the assembling of the present invention is illustrated. The seat 2 is slid into the frame 1 by the cuts 20 of the seat 2 receiving the upper rods 111 of the frame 1 and the supporting ribs 112 of the upper rods 111 received by the slots 21 of the cuts 20. With the transverse shaft 13 of the frame 1 received by the rear cut 20 of the seat 2 and the assembling sheet 131 of the transverse shaft 13 received by the positioning slot 22, the seat 2 will be fixed to the frame by inserting a fastening component 5 into the assembling sheet 131 through the through hole 221 of the seat 2 as shown in FIG. 16. The back 3 is slid into the back supports 12 of the frame 1. The back 3 is fixed to the frame 1 by inserting a fastening component 5 into the assembling sheet 121. With the simple and time-saving assembling, the chair with a tidy appearance can lower a cost of manufacture and transportation.

What is claimed is:

1. A chair assembly comprising:

a frame;

a seat; and a seat back;

the frame comprising two linked foot frames and a back support having a side extending from each of the two linked foot frames for holding the seat and the seat back, respectively; each of the two linked foot frames comprising an upper horizontal rod having an extending support rib for holding the seat; each side of the back support having an assembling sheet for connecting the seat back to the back support; each of the assembling sheets of the back support having a through hole;

the frame further comprising a transverse shaft linking the two linked foot frames on a rear of the foot frames, the transverse shaft having an assembling sheet, the assembling sheet of the transverse shaft having a through hole;

the seat having an upper surface for seating and a bottom surface opposite the upper surface, two lateral sides and a rear side between the upper surface and the bottom surface; the two lateral sides of the seat having a cut for receiving a respective one of the upper horizontal rods of the foot frames; each of the two lateral sides having a lateral slot formed within the cut for receiving a respective one of the extending support ribs; the rear side of the seat also having a rear cut for receiving the transverse shaft of the frame and a positioning slot within the rear cut for receiving the assembling sheet of the transverse shaft, wherein a through hole is formed penetrating the positioning slot for receiving a fastening component; and the seat back having two lateral sides and a bottom side, the seat back having blind holes formed in the bottom side of the seat back along each of the lateral sides for receiving each of the sides of the back support of the frame; a blind hole slot formed on an inner side and communicating with each of the blind holes for receiving the assembling sheets of the corresponding one of the back supports; a through hole penetrating each of the blind hole slots formed in a rear surface of the seat back for receiving a fastening component.

2. The chair assembly as claimed in claim 1, wherein the seat comprises a frame; an enclosed groove (23) is formed in an upper surface of the frame for fastening edges of a net cloth (4); and the edges of the net cloth (4) are wrapped around a positioning frame (6) from an outer rim of the positioning frame (6) and fixed to the positioning frame (6).

3. The chair assembly as claimed in claim 1, wherein the seat back comprises a frame; an enclosed groove (33) is formed in t-a a front surface of the frame for fastening edges of a net cloth (4); and the edges of the net cloth (4) are wrapped around a positioning frame (6) from an outer rim of the positioning frame (6) and fixed to the positioning frame (6).

* * * * *